US005410996A

United States Patent [19]

Baird

[11] Patent Number: 5,410,996

[45] Date of Patent: May 2, 1995

[54] ROTARY VALVE ASSEMBLY USED WITH RECIPROCATING ENGINES

[76] Inventor: James W. Baird, 9442 Coronet Ave., Westminster, Calif. 92683

[21] Appl. No.: 103,589

[22] Filed: Aug. 9, 1993

Related U.S. Application Data

[63] Continuation-in-part of Ser. No. 891,968, May 26, 1992, abandoned.

[51] Int. Cl.[6] ..... F01L 5/04

[52] U.S. Cl. ..... 123/190.2; 123/80 BA

[58] Field of Search ..... 123/190.1, 190.2, 190.8, 123/80 BA

[56] References Cited

U.S. PATENT DOCUMENTS

| | | | |
|---|---|---|---|
| 1,360,107 | 11/1920 | Fronk | 123/190.8 |
| 1,702,816 | 2/1929 | Danford | 123/190.2 |
| 4,658,776 | 4/1987 | Coman | 123/190.8 |
| 4,864,984 | 9/1989 | Blish | 123/190.2 |
| 5,251,591 | 10/1993 | Corrin | 123/190.8 |

FOREIGN PATENT DOCUMENTS

| | | | |
|---|---|---|---|
| 0828228 | 5/1938 | France | 123/190.8 |
| 0425680 | 10/1947 | Italy | 123/190.2 |
| 0051208 | 3/1983 | Japan | 123/190.2 |

*Primary Examiner*—Henry C. Yuen
*Assistant Examiner*—Erick Solis
*Attorney, Agent, or Firm*—Dennis W. Beech

[57] ABSTRACT

An improved rotary valve assembly that is rotated by chain, belt or gears that are driven by a reciprocating engine which has intake and exhaust rotary valves that have ports and interior channels that are sequentially positioned to allow the intake and exhaust of gases and alternatively seals the combustion chamber. The rotary valve ports and intake and exhaust ports may be varied axially and circumferential to change the engine time and gas volume capacity of the engine.

2 Claims, 6 Drawing Sheets

ROTARY VALVE ASSEMBLY USED WITH RECIPROCATING ENGINES

CROSS REFERENCES TO RELATED APPLICATIONS

This is a continuation-in-part of application Ser. No. 07/891,968 filed May 26, 1992, now abandoned.

FIELD OF THE INVENTION

The instant invention relates to an improved rotary valve rotated by chain/belt or gears having designed and positioned openings in rotary driven axles to control the intake and exhaust of a reciprocating engine. The openings direct the gases to improve engine performance.

BACKGROUND OF THE INVENTION

Reciprocating piston driven engines customarily use cams and valves to control the intake and exhaust of gases. The chain/belt controlled rotary valve engine uses a simple system in which an axle is channeled with passage ways and ports and is positioned to allow access to the combustion chamber. The channeled axles eliminate the need for valves and cams and create a much simpler and more easily assembled and maintained engine. The axles can be easily removed from the head assembly. Normal engines that use valves require valve assemblies and cams to control the intake and exhaust and require many more parts that require more intricate assembly and maintenance.

The rotary nature of the valves improves fuel efficiency and horsepower. The rotary system eliminates the cam, lifters, push rods, rocker arms, valve springs, valve guides and valves. Valve problems such as valve float that limit the revolutions per minute would not occur and allow operation at higher revolutions per minute. The rotary valve system allows smaller intake and exhaust ports to produce the same horsepower as there are no obstructions to the gas flow. Should a timing chain break, unlike valves breaking or cracking, there are no parts to damage pistons. Valve timing on any engine can be more easily accomplished with the rotary valve by adjusting the angular position of the rotary valve axle.

The rotary valve system described herein allows enlarging and shaping the cross section of the port in the head assembly and thereby making the engine more efficient. The rotors are positioned horizontally to adapt to a wide range of weight and volume requirements. Due to the nature of the rotary axle opening and head assembly ports, the ports can be varied in size to adjust for timing and volume of gases resulting in better intake and exhaust performance over a wide range of engine performance parameters.

SUMMARY OF THE INVENTION

A primary objective of the present invention is to provide rotary valves with associated ports for a rotary engine which allows for ease of control of and changes to timing and volume variance depending on the requirements for an engine application. A further object of the invention is to provide a valve and port configuration that allows for a cooler running engine as compared to rotary valves that route exhaust through hollow rotary valves. Another object of the invention is to provide the valves and ports in an engine head configuration that allows for a simple head assembly using sealing rings to control the escape of gases.

In accordance with the description presented herein, other objects of this invention will become apparent when the description and drawings are reviewed.

DESCRIPTION OF THE PREFERRED EMBODIMENT

Figure 1:
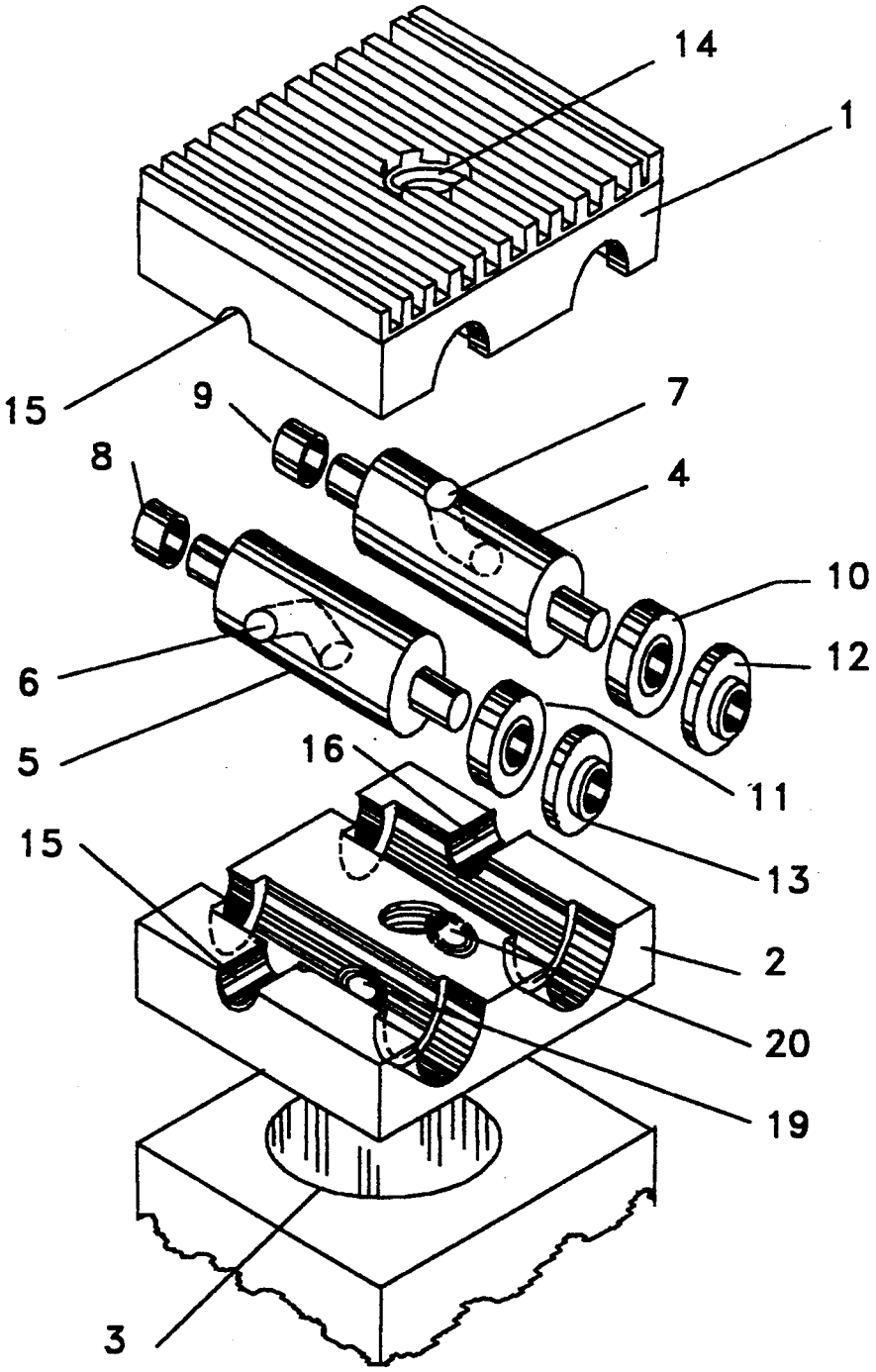
FIG. 1 illustrates an expanded view of the rotary valve head assembly with one cylinder.
Figure 2:
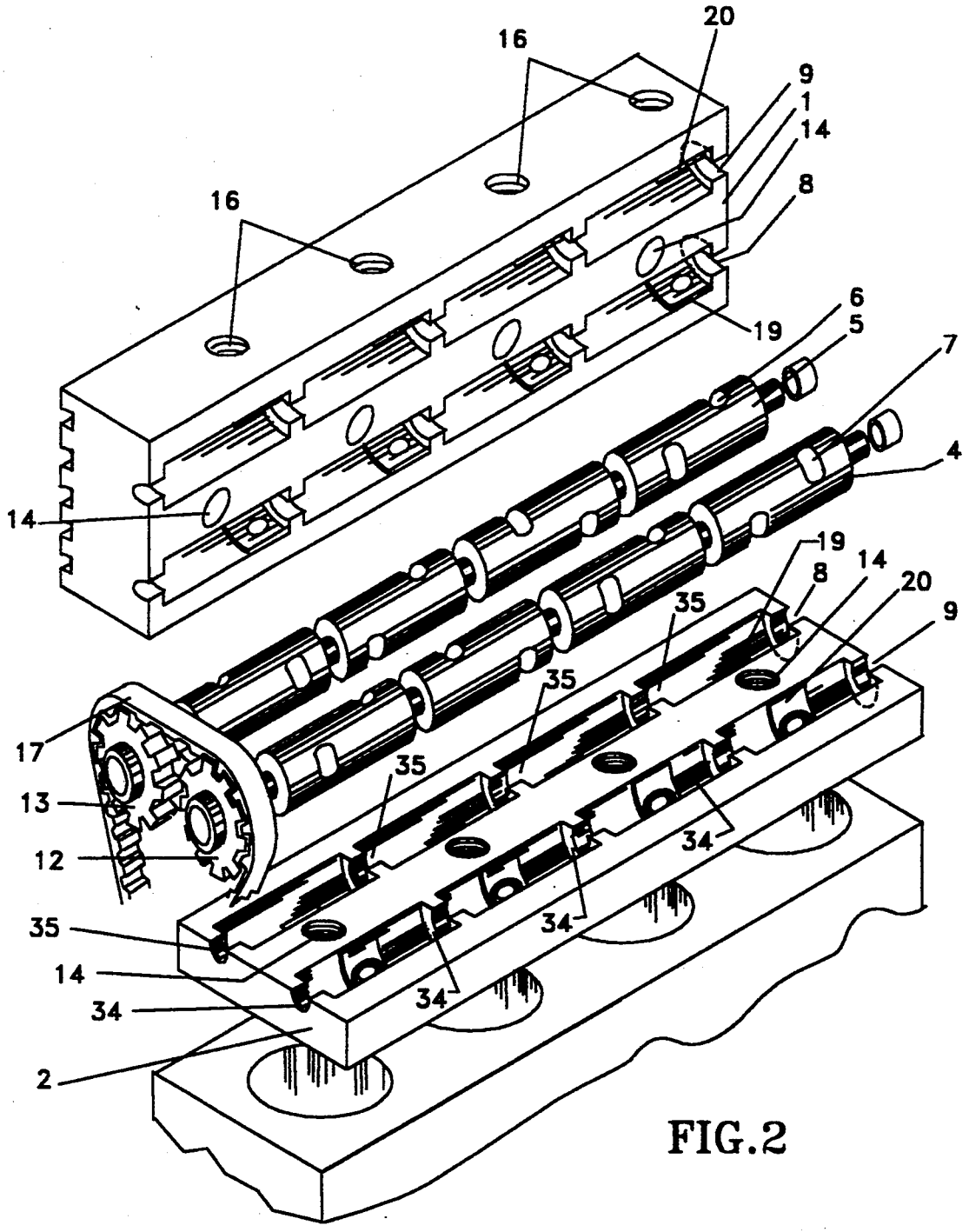
FIG. 2 illustrates an expanded view of the rotary valve head assembly with four cylinders.
Figure 3:
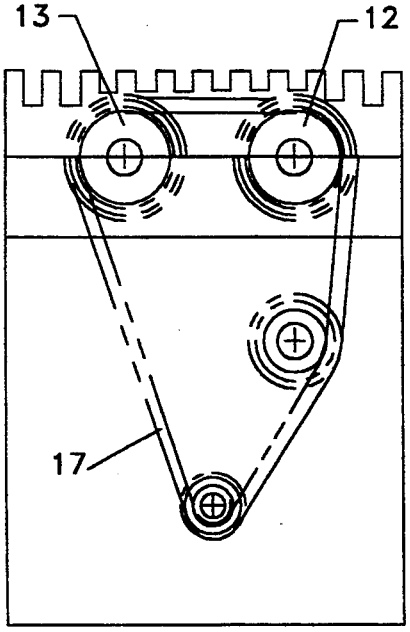
FIG. 3 illustrates a front view of the rotary valve assembly and timing belt.
Figure 4:
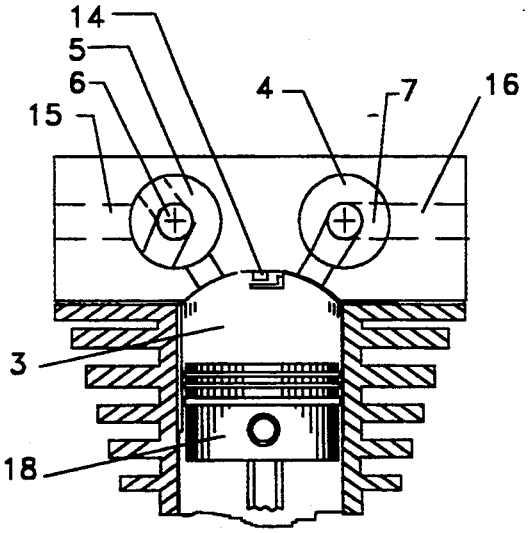
FIG. 4 illustrates a cross-sectional front view of the apparatus during the intake stroke.
Figure 5:
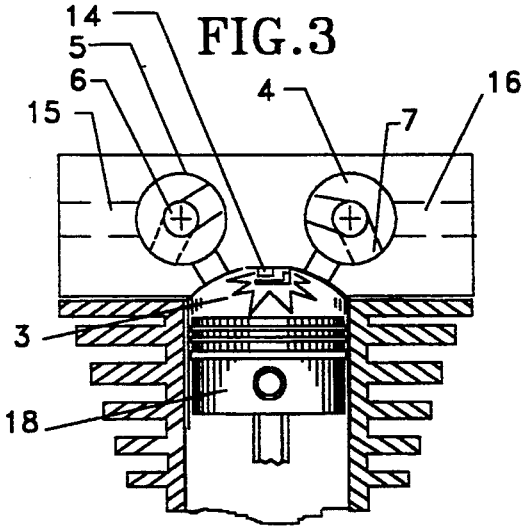
FIG. 5 illustrates a cross-sectional front view of the apparatus with the ports closed for compression and firing.
Figure 6:
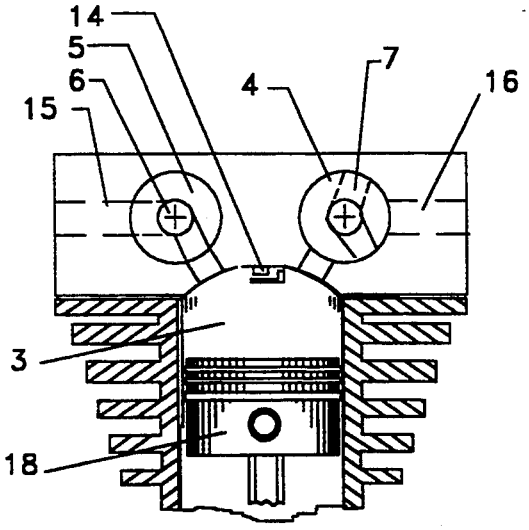
FIG. 6 illustrates a cross-sectional front view of the apparatus during exhaust.

Although any number of pistons and any orientation of each piston is feasible, a single cylinder engine and four cylinder engine are shown in FIGS. 1 and 2. Referring to FIGS. 1 through 6, the rotary valve reciprocating chain/belt controlled engine is shown. The rotary valve assembly consists of two channeled axles called rotary valves (4,5), timing chain (17), spark plug (14) and valve head (1,2). The intake rotary valve (4) controls the intake of the fuel and the exhaust rotary valve (5) controls exhausting the gases after combustion. FIGS. 4 through 6 illustrate the cycles of a gasoline or Diesel engine. The intake rotary valve (4) and exhaust rotary valve (5) turn the same number of revolutions as a similar cam activated system but there is no requirement for cams, lifters, rocker arms, push rods, valves, valve springs or valve guides. The rotary valves (4,5) turn one half revolution per every turn of the crankshaft. Referring to FIG. 4 as the intake rotary valve (4) is turned, the intake port (16) and the intake channel (7) which is within the intake rotary valve (4) align and an opening is created between the intake port (16) and the combustion chamber (3) above the piston (18). There is no obstruction to the flow of gases, such as a valve guide, valve stem or valve head used in a cam driven system. On completion of the intake cycle the intake channel (7) is no longer aligned with the intake port (16) and the combustion chamber (3) is sealed as shown in FIG. 5. FIG. 6 shows that after the piston (18) is positioned at the appropriate time and the combustion complete, the exhaust channel (6) within the exhaust rotary valve (5) aligns between the exhaust port (15) and the combustion chamber (3) and the gases under pressure are expelled. The timing of events is controlled by the rotation of the rotary valves (4, 5) and timing chain (17).

The horsepower that is required to turn the rotary valves (4, 5) are considerably less then the horsepower required to turn the cam and operate all the components of a cam driven valve system. The rotary valves (4, 5) can be designed to turn and operate the same as any dual overhead cam engine.

Figure 7:
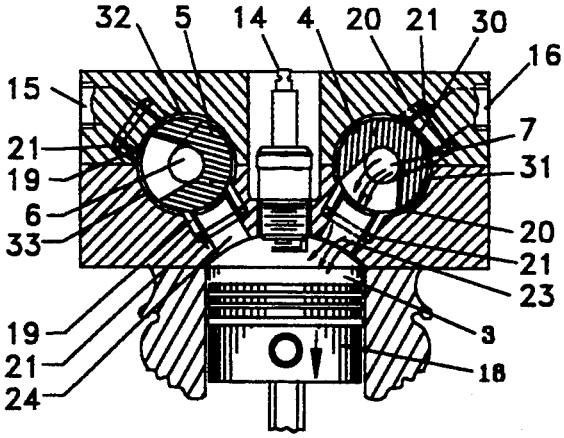
FIG. 7 illustrates a cross-sectioned front view of the apparatus during intake cycle with the intake channel and exhaust channel widened at their ports to vary timing and volume.
Figure 8:
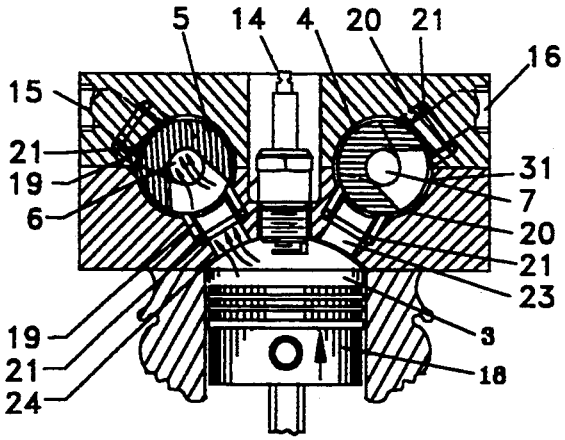
FIG. 8 illustrates a cross-sectioned front view of the apparatus during exhaust cycle with the intake channel and exhaust channel widened at their ports to vary timing and volume.
Figure 9:
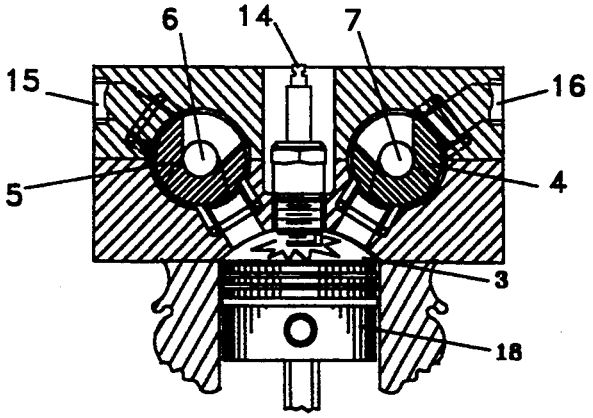
FIG. 9 illustrates a cross-sectioned front view of the apparatus during compression and firing.

The intake channel (7), intake rotor port (30) and intake rotor cylinder port (31) as well as the exhaust channel (6), exhaust rotor port (32) and exhaust rotor cylinder port (33) can be elongated circumferentially as shown in FIGS. 7 through 9 to duplicate any valve timing openings and closings desired. The intake port (16), exhaust port (15), cylinder intake port (23) and cylinder exhaust port (24) may also be similarly varied in size. The same elements may also be varied in size in the axial direction of the intake rotary valve (4) and exhaust rotary valve (5) to accommodate the optimum volume of intake or exhaust gases to produce the greatest horsepower or efficiency as required.

The intake channel (7) and exhaust channel (6) are channeled such that their ports (30, 31, 32, 33) open at different points axially along the rotary valves (4, 5). This allows for timing and sealing options such that for example the intake rotor port (30) passes over the intake port (16) but not the cylinder intake port (23).

The duration of maximum port opening time, coupled with the rotor passageways, may be made considerably longer in duration than that of a normal existing valve maximum opening time. Normal existing cam actuated valves are limited by the shape of the cam and of the valve spring where as the instant invention has no such limitation and many arrangements of both port and passageway sizes and shapes may be used.

Referring more specifically to FIG. 7 as the intake rotary valve (4) is turned, the intake port (16) and the intake channel (7) which is within the intake rotary valve (4) align and an opening is created between the intake port (16) in the head and the cylinder intake port (23) passing into the combustion chamber (3) above piston (18). To ensure proper flow of intake gases and provide for combustion, intake seals (20) must be installed. To ensure pressure of the seals to the rotary shaft an "O" ring (21) or equivalent may be used. For the exhaust a similar seal arrangement using exhaust seals (19) is required.

Figure 10:
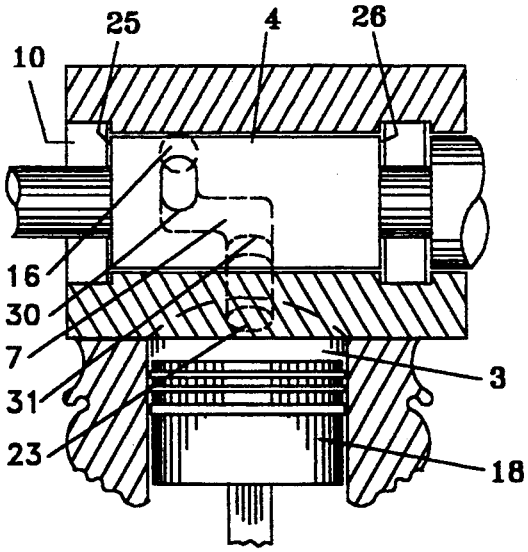
FIG. 10 illustrates a cross-sectioned side view of the head with the intake rotary valve and the intake channel shaped.

Referring to FIGS. 10–14, the intake port (16) shape is shown superimposed on the intake rotor port (30). Referring to FIG. 10, a typical intake port (16) shape is shown round and the combustion port (23) has the same configuration. The intake channel (7), being the same width as the ports (16) and (23), is shown with an axial offset to provide proper sealing and the intake channel (7), intake rotor port (30) and intake rotor cylinder port (31) are shown elongated circumferentially to match the timing of valve opening and closing. Spring washers (25) and (26) are required to ensure proper end play clearance for rotary valve (4).

Figure 11:
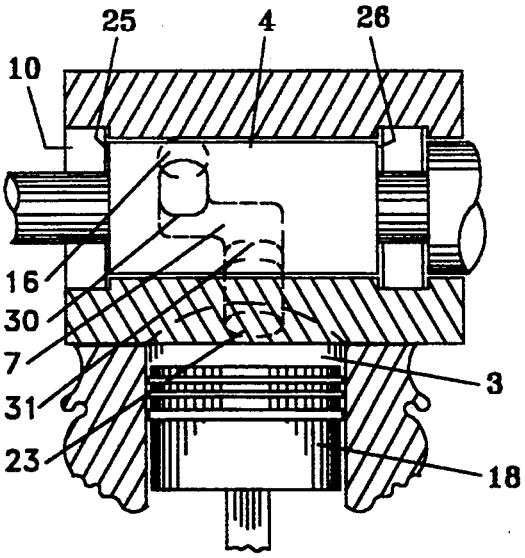
FIG. 11 illustrates a cross-sectioned view of the head with the intake rotary valve and the intake channel shaped in an alternate configuration.

Referring to FIG. 11, a typical intake port (16) shape is shown elongate axially relative to the intake rotary valve (4) to increase the required volume compared to FIG. 10 and a cylinder intake port (23) being the same configuration. The intake channel (7) and its ports (30, 31), being the same width as the head ports (16) and (23), is shown with an offset to provide proper timing and sealing. Spring washers or equivalent (25) and (26) are required to ensure proper end play clearance, for rotary valve (4).

Figure 12:
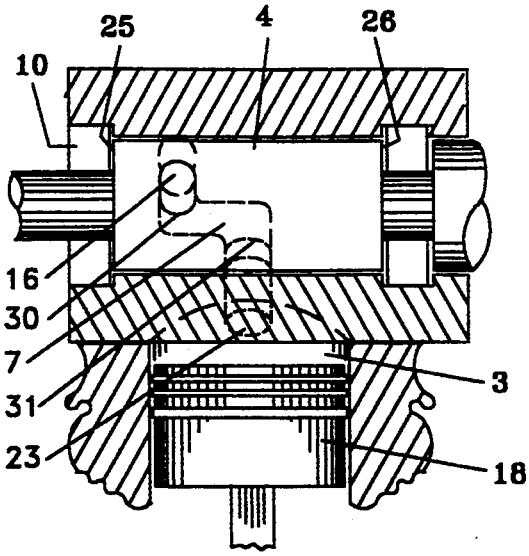
FIG. 12 illustrates a cross-sectioned view of the head with the intake rotary valve and the intake channel shaped in an alternate configuration.

Referring to FIG. 12, a typical intake port (16) shape is shown narrowed axially to reduce the required volume compared to FIG. 10, and a combustion port (23) being the same configuration. The intake channel (7) is the same width as the ports (16) and (23) and is shown with an offset to provide proper timing and sealing and the channel (7) is shown as being elongated circumferentially to match opening and closing valve timing. Spring washers or equivalent (25) and (26) are required to ensure proper end play clearance for rotary valve (4).

Figure 13:
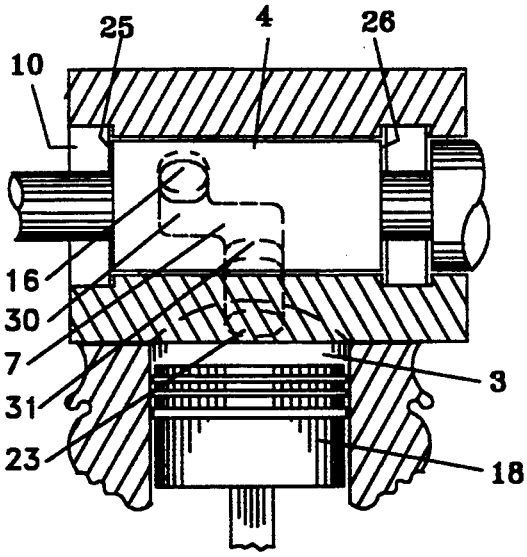
FIG. 13 illustrates a cross-sectioned view of the head with the intake rotary valve and the intake channel shaped in an alternate configuration.

Referring to FIG. 13, a typical intake port (16) shape is shown as being widened horizontally to a rectangular configuration to produce an increase in the required volume if space or area is a problem compared to FIG. 10, and a combustion port (23) being the same configuration. The intake channel (7), being the same width as the ports (16) and (23), is shown with an offset to provide proper timing and sealing and the channel (7) is shown as being elongated circumferentially to match opening and closing valve timing. Spring washers or equivalent (25) and (26) are required to ensure proper end play clearance for rotary valve (4).

Figure 14:
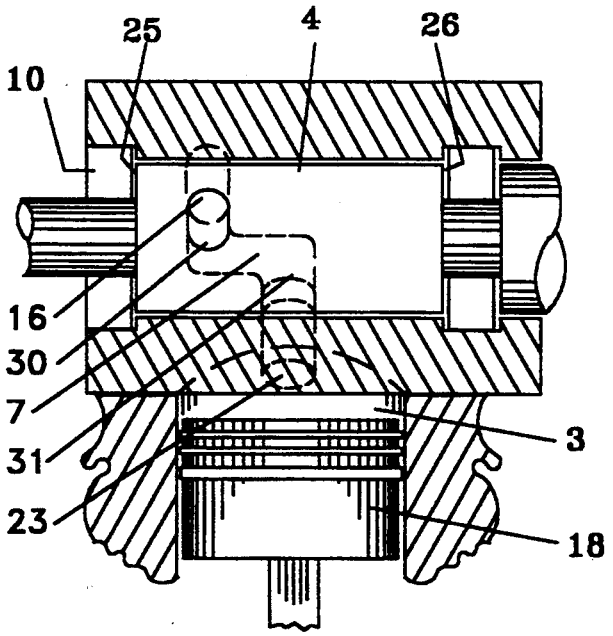
FIG. 14 illustrates a cross-sectioned view of the head with the intake rotary valve and the intake channel shaped in an alternate configuration.
Figure 15:
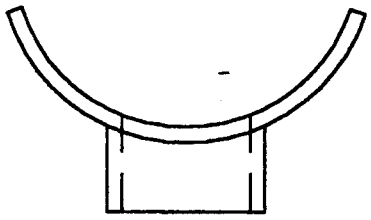
FIG. 15 illustrates a side view of the exhaust and intake valve seals.
Figure 16:
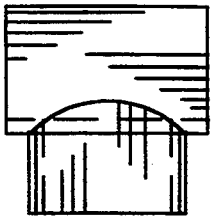
FIG. 16 illustrates an end view of the exhaust and intake valve seals.
Figure 17:
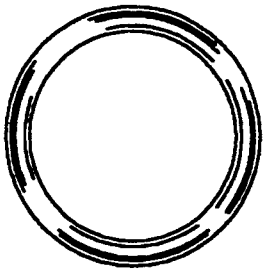
FIG. 17 illustrates the "O" ring.
Figure 18:
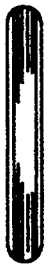
FIG. 18 illustrates a side view of the "O" ring.

Referring to FIG. 14, a typical intake port (16) shape and cylinder intake port (23) is shown elongated circumferentially relative to intake rotary valve (4). Such elongation allows the valve to open earlier and close later, either one or both, depending on which end is elongated. If the leading edge of the ports (16) and (23) when compared to the rotation of intake rotary valve (4) are elongated the valve opens sooner. If the trailing edge of the ports (16) and (23) are elongated the valve closes later. The above change may also be accomplished by elongating circumferentially the intake channel (7) ports (30, 31), at both ends, in intake rotary valve (4). The intake channel (7), being the same width as the ports (16) and (23), is shown with an offset to provide proper timing and sealing and the intake channel (7) is shown as elongated circumferentially to match opening and closing valve timing. Spring washers or equivalent (25) and (26) are required to ensure proper end play clearance for rotary valve (4).

Referring to FIG. 9, the intake and exhaust rotary valves (4, 5) are shown with no opening aligning with ports passing into the combustion chamber (3). During this time the fuel and air are compressed and the mixture ignited.

Referring to FIG. 8, as the exhaust rotary valve (5) is turned, the exhaust port (15) and the exhaust channel (6) which is within the exhaust rotary valve (5) align and an opening is created between the exhaust port (15) in the head and the cylinder exhaust port (24) passing to combustion chamber (3) above piston (18). To ensure proper flow of exhaust gases and provide for combustion, seals (19) must be installed. To provide pressure of the seals to the rotary shaft an "O" ring (21) or equivalent must be used.

Referring to FIGS. 15 through 18, an end view and a side view is shown of a typical seal and "O" ring to be used at each head port for intake and exhaust. The use of such seals provides for ease of engine assembly as special machining is not required to prevent escape of gases.

Material for the intake and exhaust seals should be similar to Teflon or equivalent. Material for the "O" ring should be similar to Buna-N or equivalent.

Referring to FIGS. 1 and 2, at the forward end of the intake rotary valve (4) and the exhaust rotary valve (5) are the intake valve forward bearing (10) and exhaust valve forward bearing (11), respectively. At the rear of the intake rotary valve (4) and exhaust rotary valve (5) are the intake valve rear bearing (9) and the exhaust valve rear bearing (8), respectively. The cavities (34) and (35) for the bearings retain the bearings in the head assembly. On the forward end of the intake rotary valve (4) is an intake rotary valve chain driven sprocket (12). On the forward end of the exhaust rotary valve (5) is an exhaust valve chain driven sprocket (13). The intake and exhaust valve chain driven sprockets (12, 13) are fixed to the rotary valves (4, 5) and in cooperation with the timing chain (17) control the opening and closing of the valves (4, 5).

I claim:

1. A rotary valve assembly rotated by a drive mechanism comprising:

a. a reciprocating piston block assembly crankshaft and firing mechanism;

b. a head assembly that attaches to the block assembly;

c. an exhaust rotary valve housed within the head assembly and having a plurality of channels that allow gases to flow from a combustion chamber above a piston to outside the engine assembly wherein the channels are offset in the exhaust rotary valve such that an exhaust rotor port and an exhaust rotor cylinder port of each channel for each piston are not in alignment in a plane perpendicular to the exhaust rotor valve axis and there is independent for each channel an exhaust port and a cylinder exhaust port in the head assembly;

d. an intake rotary valve housed within the head assembly and having a plurality of channels that allow gases to be drawn into a combustion chamber above a piston wherein the channels are offset in the intake rotary valve such that an intake rotor port and an intake rotor cylinder port of each channel for each piston are not in alignment in a plane perpendicular to the intake rotor valve axis and there is independent for each channel an intake port and a cylinder intake port in the head assembly;

e. a drive mechanism that connects the crankshaft to the angular orientation of the intake rotary valve and exhaust rotary valve and when driven opens the intake rotary valve and exhaust rotary valve at alternate times; and f. exhaust and intake seals that are shaped to conform to the exhaust or intake rotary valve and allow the gases to pass into the appropriate port and substantially reduce the gas passing around the intake or exhaust rotary shaft or head assembly.

2. A Rotary Valve Assembly as in claim 1 wherein the cross section of the ports are elongated circumferentially.

* * * * *